US010971090B2

(12) United States Patent
Kuei et al.

(10) Patent No.: US 10,971,090 B2
(45) Date of Patent: Apr. 6, 2021

(54) METHOD FOR PREVENTING IMAGE STICKING IN DISPLAY PANEL

(71) Applicant: NOVATEK Microelectronics Corp., Hsin-Chu (TW)

(72) Inventors: Cheng-Kai Kuei, Hsinchu (TW); Hsi-Mao Yu, Tainan (TW); Syang-Yun Tzeng, Taoyuan (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

(21) Appl. No.: 16/233,141

(22) Filed: Dec. 27, 2018

(65) Prior Publication Data

US 2020/0211488 A1 Jul. 2, 2020

(51) Int. Cl.
*G09G 3/36* (2006.01)

(52) U.S. Cl.
CPC ..... *G09G 3/3614* (2013.01); *G09G 3/3685* (2013.01); *G09G 3/3696* (2013.01); *G09G 2320/0257* (2013.01)

(58) Field of Classification Search
CPC .. G09G 3/3614; G09G 3/3685; G09G 3/3696; G09G 2320/0257
See application file for complete search history.

(56) References Cited

U.S. PATENT DOCUMENTS 6,747,624 B1 * 6/2004 Udo ..... G09G 3/3685 345/210
2005/0083479 A1 * 4/2005 Okumura ..... G02F 1/134336 349/178
2008/0170024 A1 * 7/2008 Song ..... G09G 3/3614 345/96
2015/0243239 A1 * 8/2015 Uemura ..... G09G 3/3614 345/209
2016/0125822 A1 * 5/2016 Kang ..... G09G 3/2003 345/691

* cited by examiner

*Primary Examiner* — Towfiq Elahi
(74) *Attorney, Agent, or Firm* — Winston Hsu

(57) ABSTRACT

The present invention discloses a method for a source driver, for preventing image sticking in a display panel coupled to the source driver. The source driver includes a first output driver and a second output driver having different polarities. The first output driver is configured with a first driving capability and the second output driver is configured with a second driving capability. The method includes the steps of: obtaining an effective voltage of a pixel in the display panel; and adjusting the second driving capability of the second output driver to be identical to the first driving capability of the first output driver, to allow the adjusted second driving capability to drive the effective voltage to reach a level having the same magnitude as a level of the effective voltage driven by the first source driver with the same variation of display data.

10 Claims, 10 Drawing Sheets

METHOD FOR PREVENTING IMAGE STICKING IN DISPLAY PANEL

BACKGROUND OF THE INVENTION

1. Field of the Invention

The present invention is related to a method used for a display panel and a display control system, and more particularly, to a method and a display control system for preventing or reducing image sticking in a display panel.

2. Description of the Prior Art

Liquid crystal display (LCD) is the highest developed and the most popular display among various flat panel displays in the market. After long time operations of the LCD, the liquid crystal molecules may approach both sides of the capacitor and may be accumulated on the electric plates, which causes imbalance of the electric field and thereby generates image sticking. For example, please refer to FIG. 1, which is a common display pattern on an LCD panel, where the display pattern shows a checkered image. After a long term display of the checkered pattern, image sticking may appear as horizontal weak lines at the boundaries of black and white colors if the display panel shows another image.

There are several causes of the image sticking. One of the most common causes is the inconsistency of driving capability of the operational amplifier in the source driver. In order to solve the image sticking problem, a common method applies alternation of positive and negative polarities such as dot inversion, line inversion or frame inversion to output display data, allowing the liquid crystal molecules to be uniformly distributed across the electric fields of the liquid crystal capacitors.

Therefore, with the polarity inversion schemes, there may be two operational amplifiers configured with different polarities for driving the liquid crystal molecules and outputting display data to one pixel. However, due to the process variation and mismatch, each operational amplifier may possess different performances on the driving capability. If the driving capability of the operational amplifier with positive polarity and the driving capability of the operational amplifier with negative polarity are different, these two operational amplifiers cannot generate the effective voltage having the same magnitude in the pixel. After a long time operation with asymmetric driving capability, the liquid crystal molecules in the pixel may easily be polarized at an angle when no display data is received, resulting in image sticking. Therefore, the image sticking problem has become an important issue to be solved in this art.

SUMMARY OF THE INVENTION

It is therefore an objective of the present invention to provide a method for preventing or reducing image sticking appearing in a display panel such as a liquid crystal display (LCD) panel.

An embodiment of the present invention discloses a method for a source driver, for preventing image sticking in a display panel coupled to the source driver. The source driver comprises a first output driver and a second output driver having different polarities. The first output driver is configured with a first driving capability and the second output driver is configured with a second driving capability. The method comprises the steps of: obtaining an effective voltage of a pixel in the display panel; and adjusting the second driving capability of the second output driver to be identical to the first driving capability of the first output driver, to allow the adjusted second driving capability to drive the effective voltage to reach a level having the same magnitude as a level of the effective voltage driven by the first source driver with the same variation of display data.

Another embodiment of the present invention discloses a method for a timing controller, for preventing image sticking in a display panel controlled by the timing controller via a source driver. The source driver comprises a first output driver and a second output driver having different polarities. The method comprises the steps of: obtaining an effective voltage of a pixel in the display panel; controlling the first output driver to output a first display data to the pixel in a first image frame; and controlling the second output driver to output a second display data to the pixel in a second image frame with a delay time. The delayed second display data allows the effective voltage to reach a level having the same magnitude as a level of the effective voltage allowed by the first display data when the first display data and the second display data have the same data variation.

Another embodiment of the present invention discloses a method for a timing controller, for preventing image sticking in a display panel controlled by the timing controller via a source driver. The source driver comprises a first output driver and a second output driver having different polarities. The method comprises the steps of: obtaining an effective voltage of a pixel in the display panel; controlling the first output driver to output a first display data to the pixel in a first image frame; modifying a second display data to generate a third display data; and controlling the second output driver to output the third display data in a second image frame. The third display data allows the effective voltage to reach a level having the same magnitude as a level of the effective voltage allowed by the first display data when the first display data and the second display data have the same data variation.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
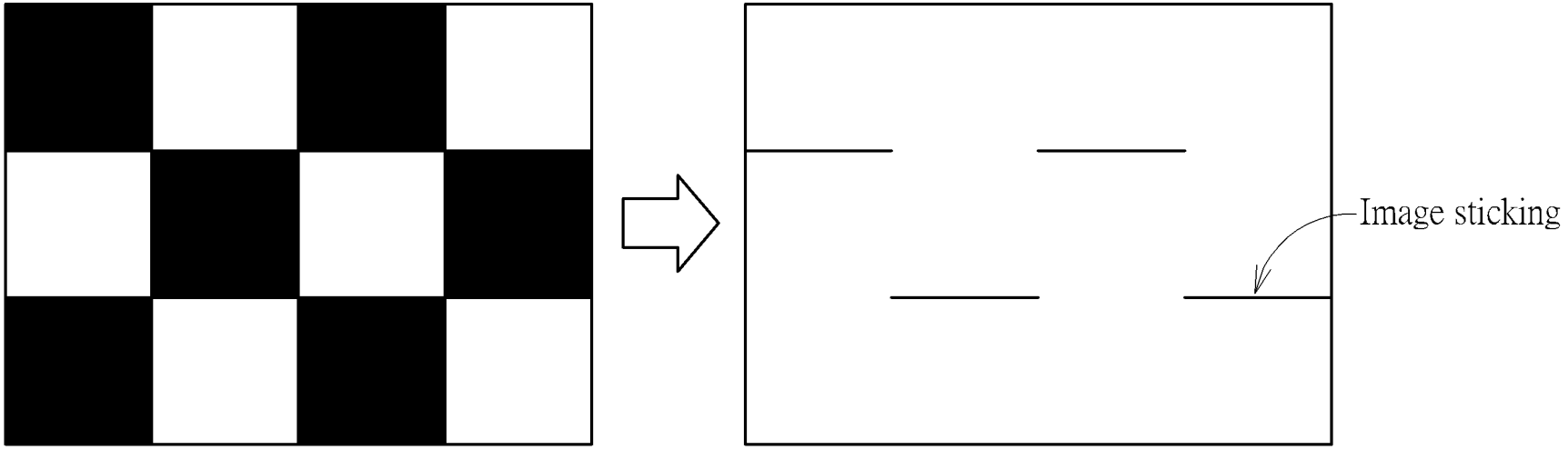
FIG. 1 PRIOR ART
FIG. 1 is a common display pattern showing a checkered image on an LCD panel.
Figure 2:
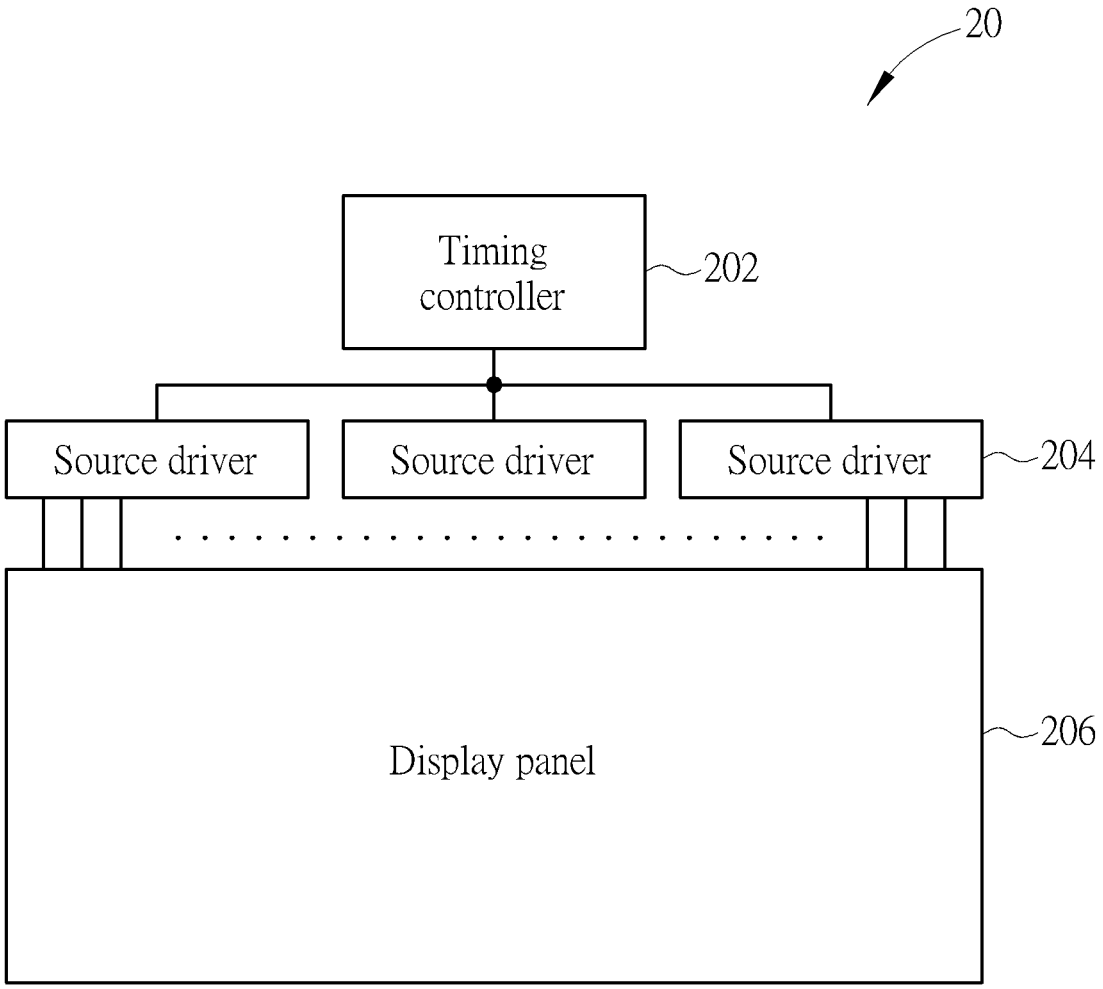
FIG. 2 is a schematic diagram of a display control system according to an embodiment of the present invention.

Please refer to FIG. 2, which is a schematic diagram of a display control system 20 according to an embodiment of the present invention. As shown in FIG. 2, the display control system 20 includes a timing controller 202, at least one source driver 204 and a display panel 206. The timing controller 202 is configured to control the operations of the display panel 206. For example, the timing controller 202 may convert the input image data to a format recognizable by the source driver 204 and forward the image data to the source driver 204. The timing controller 202 may control the timing of transmitting image data to the display panel 206, and also control a gate driver (not illustrated) to turn on corresponding pixels on the display panel 206 to receive the image data. The source driver 204 is configured to forward the image data to the display panel 206. In general, the source driver 204 may convert digital image data to an analog form, and output the analog image data by driving the liquid crystal capacitor in the target pixel. Each of the timing controller 202 and the source driver 204 may be implemented with an integrated circuit to be included in a chip. In an embodiment, the timing controller 202 and the source driver 204 may be integrated into a single chip.

As mentioned above, the image sticking is mainly resulted from inconsistency of driving capability of the operational amplifier in the source driver 204. Therefore, an embodiment of the present invention provides a method for solving the image sticking problem by modifying the driving capability of the output driver(s) such as the operational amplifier(s).

Figure 3:
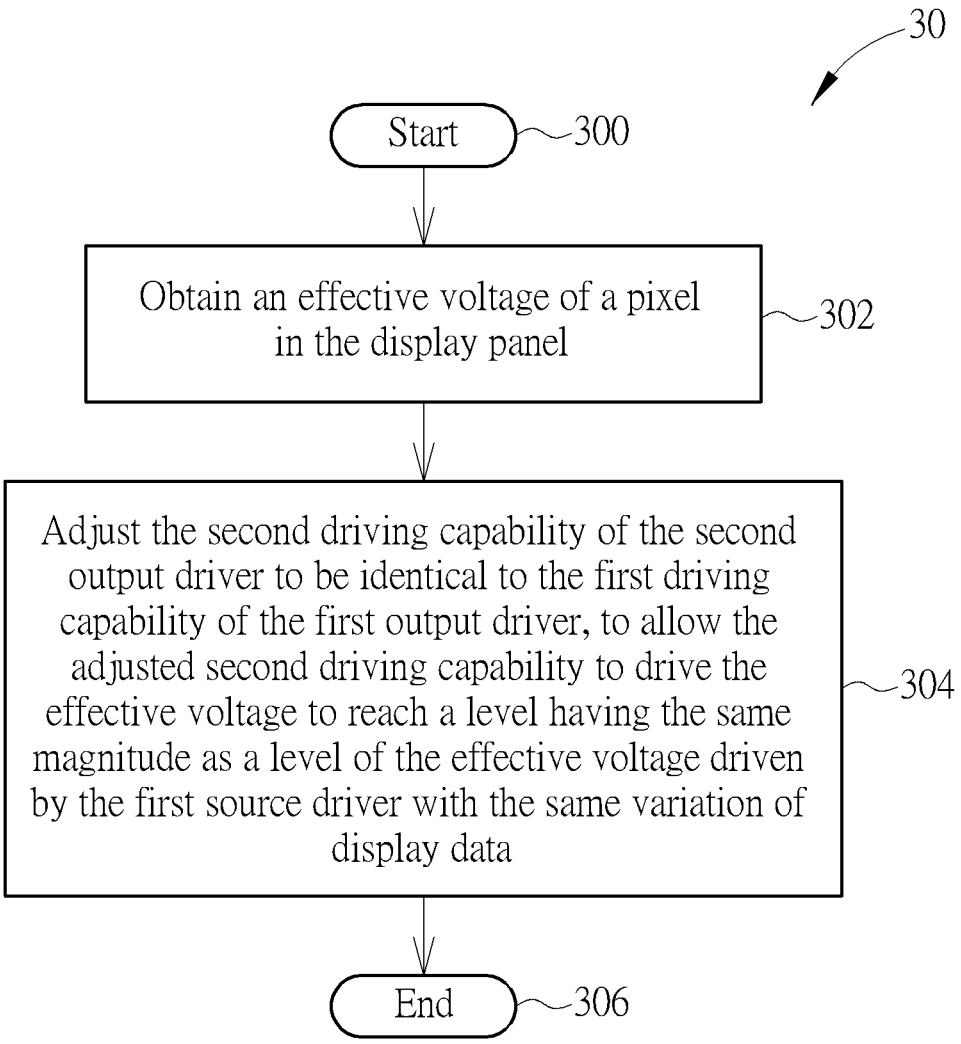
FIG. 3 is a flowchart of a process according to an embodiment of the present invention.

Please refer to FIG. 3, which is a flowchart of a process 30 according to an embodiment of the present invention. The process 30 may be utilized in a source driver of a display control system such as the source driver 204 shown in FIG. 2, to reduce or prevent image sticking appearing in a display panel coupled to the source driver, wherein the source driver includes a first output driver and a second output driver having different polarities. The process 30 includes the following steps:

Step 300: Start.

Step 302: Obtain an effective voltage of a pixel in the display panel.

Step 304: Adjust the second driving capability of the second output driver to be identical to the first driving capability of the first output driver, to allow the adjusted second driving capability to drive the effective voltage to reach a level having the same magnitude as a level of the effective voltage driven by the first source driver with the same variation of display data.

Step 306: End.

Figure 4:
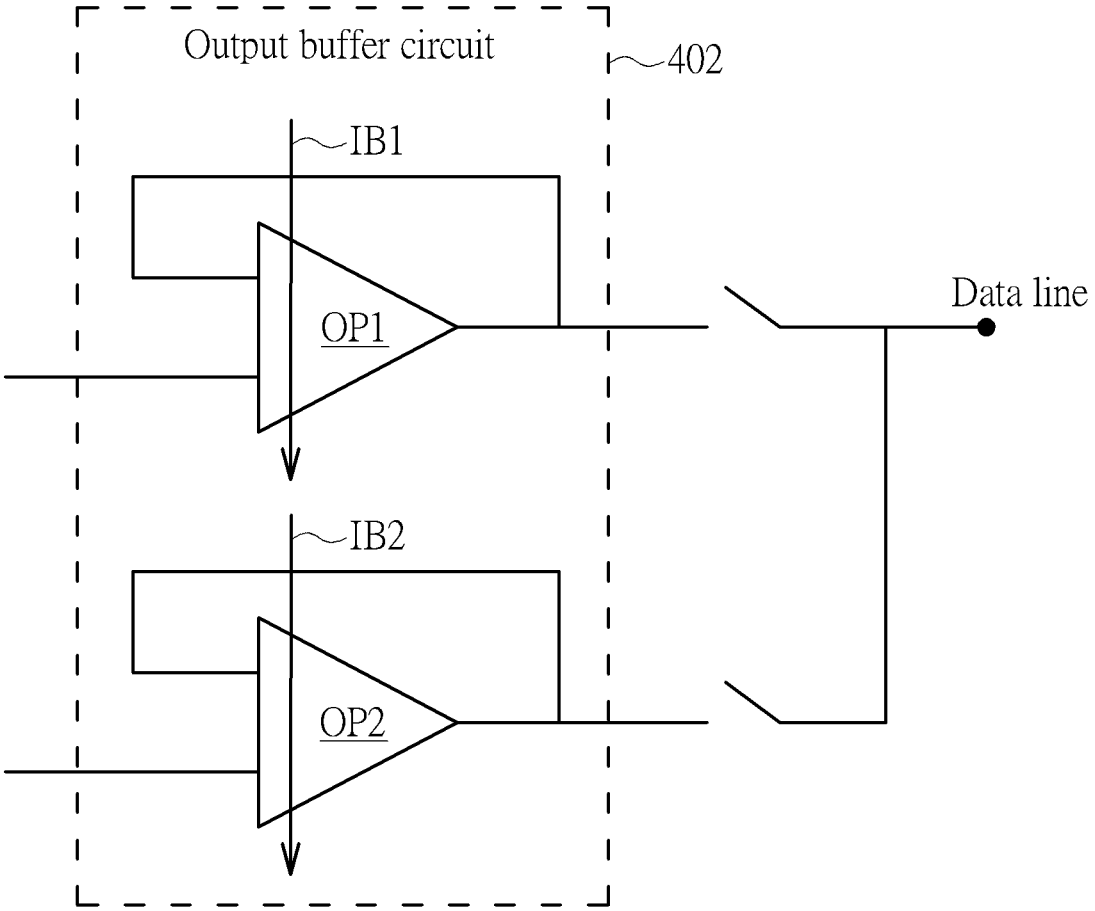
FIG. 4 is a schematic diagram of an output buffer circuit of the source driver.

In general, the source driver 204 may include an output buffer circuit, which includes a plurality of output drivers, each of which belongs to a channel for driving a column of pixels in the display panel 206. If the polarity conversion scheme is applied, a pixel in the display panel 206 may be driven by two output drivers alternately, where the first output driver is configured to output display data having positive polarity and the second output driver is configured to output display data having negative polarity to the pixel. For example, as shown in FIG. 4, the output buffer circuit 402 of the source driver 204 includes two output drivers OP1 and OP2, which are coupled to a data line in the display panel 206. The output driver OP1 is configured to output display data having positive polarity, and the output driver OP2 is configured to output display data having negative polarity. In an image frame, the output driver OP1 may output a first display data to a pixel, and in the next image frame, the output driver OP2 may output a second display data to the same pixel, so as to realize polarity inversion. Each of the output drivers OP1 and OP2 may be implemented with an operational amplifier connected as a buffer.

According to the process 30, the source driver 204 may obtain an effective voltage of the pixel, and then adjust the driving capability of the output driver OP1 and/or OP2 based on the effective voltage of the pixel. In an embodiment, the driving capability of the output driver OP2 may be adjusted to be identical to the driving capability of the output driver OP1. In the display process, the effective voltage of the pixel may be charged to a target level if the driving capability of the output driver is enough, while the effective voltage may not reach the target level if the driving capability of the output driver is not enough. Therefore, the driving capability of the output driver OP2 after being adjusted will drive the effective voltage to reach a level having the same magnitude as the effective voltage level driven by the output driver OP1, with the same variation of display data outputted by the output drivers OP1 and OP2. Therefore, the output drivers with positive polarity and negative polarity have identical driving capability which generates the same magnitude of effective voltage in the pixel. In such a situation, the image sticking problem may be reduced or prevented.

Please note that the effective voltage of the pixel may refer to a voltage received by the liquid crystal capacitor and the liquid crystal molecules in the pixel, where the effective voltage together with the common voltage VCOM may drive the liquid crystal molecules to be twisted to a specific angle to generate a desired image. Therefore, if the driving capability of these output drivers is identical, the liquid crystal molecules in the pixel may be driven by the display data with similar intensity in positive and negative polarities after long time operations, so that the image sticking problem may be prevented or reduced.

Figure 5:
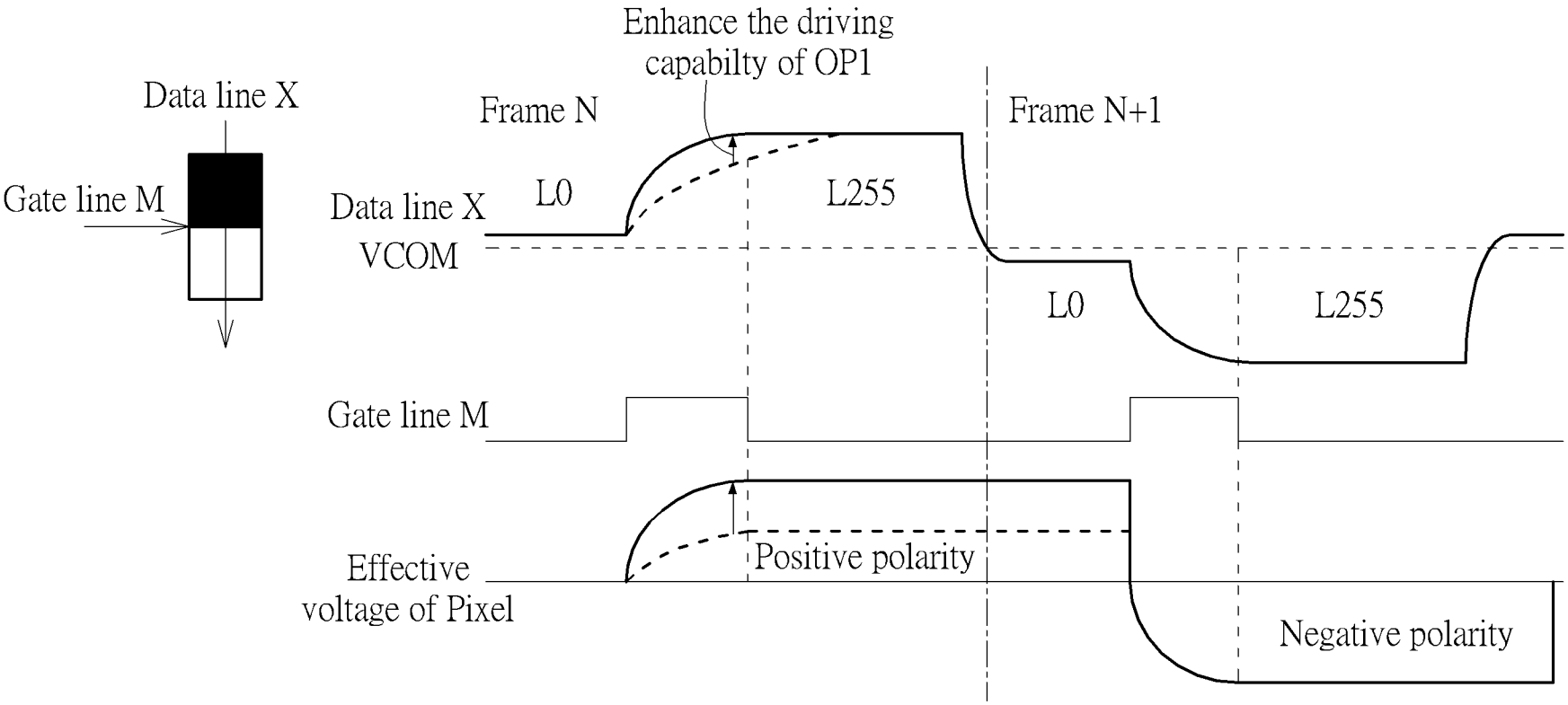
FIG. 5 is a waveform diagram of a specific pixel in the display panel driven by the output drivers.

Please refer to FIG. 5, which is a waveform diagram of a specific pixel in the display panel 206 driven by the output drivers OP1 and OP2. The pixel, which may be at a boundary of the black image and white image of the checkered pattern, is driven by the corresponding output drivers OP1 and OP2 via a data line X and is correspondingly turned on by a gate control signal via a gate line M. In the frame N, the pixel receives display data with a data value L255 in positive polarity from the output driver OP1; and at the next frame N+1, the pixel receives display data with the same data value L255 in negative polarity from the output driver OP2. At the boundary of the checkered pattern, the voltage of the data line X changes from a level corresponding to the data value L0 in the previous display data to a level corresponding to the data value L255 in the present display data; hence, the data variation between L0 and L255 is the same in positive and negative polarities. Each data value may refer to a value of the digital to analog converter (DAC) in the corresponding channel of the source driver, where the DAC receives an 8-bit input data codes ranging from 0 to 255.

As shown in FIG. 5, with the data variation from L0 to L255, the original driving capability of the output driver OP1 is not strong enough to push the voltage of the data line X to reach its target level before the gate control signal ends, such that the effective voltage of the pixel cannot reach its target level. In such a situation, the driving capability of the output driver OP1 may be enhanced, to drive the data line X to reach its target voltage earlier, so as to increase the effective voltage to a level having the same magnitude as the effective voltage level driven by the output driver OP2 in the frame N+1. The effective voltage may be represented by the final voltage level achieved after the gate driving signal ends. More specifically, the adjustment of driving capability changes the voltage of the data line X from the dashed line to the solid line; meanwhile, the effective voltage in positive polarity increases from the dashed line to the solid line.

As can be seen, in the output buffer circuit 402 as shown in FIG. 4, the driving capability of the output driver OP1 having positive polarity may be adjusted to conform to the driving capability of the output driver OP2 having negative polarity. Alternatively, the driving capability of the output driver OP2 having negative polarity may be adjusted to conform to the driving capability of the output driver OP1 having positive polarity. In another embodiment, the driving capability of both of the output drivers OP1 and OP2 may be adjusted to a predetermined level and equal to each other.

In an embodiment, the driving capability of an output driver may be adjusted by tuning the bias signal(s) of the output driver. As shown in FIG. 4, the output drivers OP1 and OP2 receive the bias signals IB1 and IB2, respectively. In such a situation, the output drivers OP1 and OP2 are provided with different bias signals which may be generated from different bias signal sources and/or with different bias configurations; hence, the bias signal control of each output driver may be performed independently. For example, the bias signal IB1 received by the output driver OP1 may be adjusted when the bias signal IB2 received by the output driver OP2 remains unchanged. Alternatively, the bias signal IB2 received by the output driver OP2 may be adjusted when the bias signal IB1 received by the output driver OP1 remains unchanged. Note that the bias signal may be a bias voltage or a bias current that is capable of adjusting the driving capability of the output driver.

In the conventional output buffer circuit, all output drivers share the same bias signals; hence, the adjustment of driving capability for each output driver should be performed simultaneously. The driving capability of the output driver with positive polarity cannot be adjusted in a manner different from the adjustment of driving capability of the output driver with negative polarity. In comparison, in the present invention, the driving capability of the output driver with positive polarity and the driving capability of the output driver with negative polarity are controlled respectively and independently, since these output drivers are supplied with different bias signals.

Please note that the effective voltage in the pixel may be adjusted in other manners according to the embodiments of the present invention.

Figure 6:
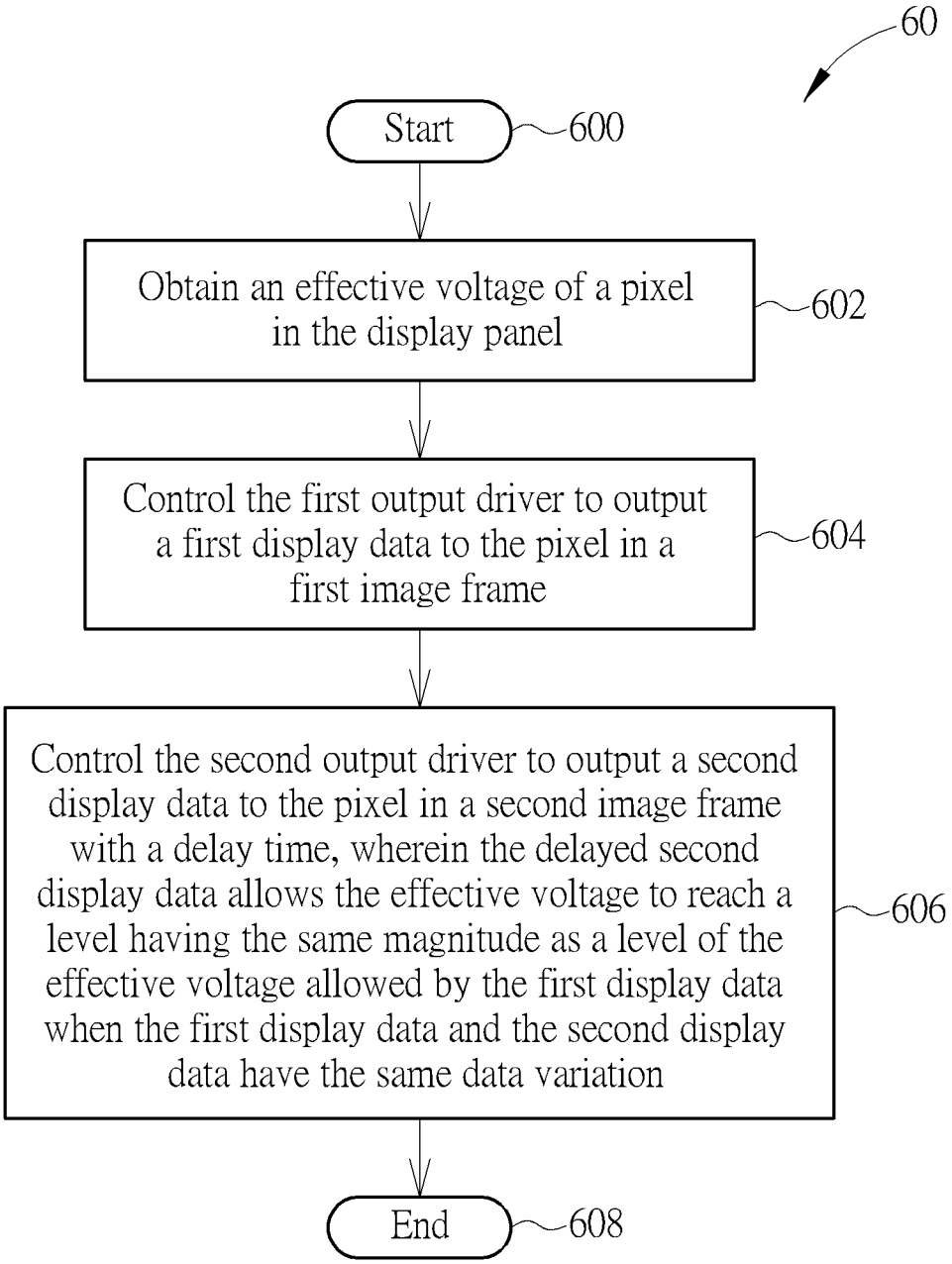
FIG. 6 is a flowchart of a process according to an embodiment of the present invention.

Please refer to FIG. 6, which is a flowchart of a process 60 according to an embodiment of the present invention. The process 60 may be utilized in a timing controller of a display control system such as the timing controller 202 shown in FIG. 2, to reduce or prevent image sticking appearing in a display panel controlled by the timing controller via the source driver, wherein the source driver includes a first output driver and a second output driver having different polarities. The process 60 includes the following steps:

Step 600: Start.

Step 602: Obtain an effective voltage of a pixel in the display panel.

Step 604: Control the first output driver to output a first display data to the pixel in a first image frame.

Step 606: Control the second output driver to output a second display data to the pixel in a second image frame with a delay time, wherein the delayed second display data allows the effective voltage to reach a level having the same magnitude as a level of the effective voltage allowed by the first display data when the first display data and the second display data have the same data variation.

Step 608: End.

According to the process 60 together with the display control system 20 shown in FIG. 2 and the output buffer circuit 402 shown in FIG. 4, the timing controller 202 may control the output driver OP1 to output a first display data to a pixel in an image frame and control the output driver OP2 to output a second display data to the pixel in another image frame with a delay time, and obtain the effective voltage of the pixel. With the delay time, the second display data allows the effective voltage to reach a level having the same magnitude as the effective voltage level allowed by the first display data when the first display data and the second display data have the same data variation. As a result, the display data of the output drivers OP1 and OP2 may generate similar effects on the effective voltage level.

Figure 7:
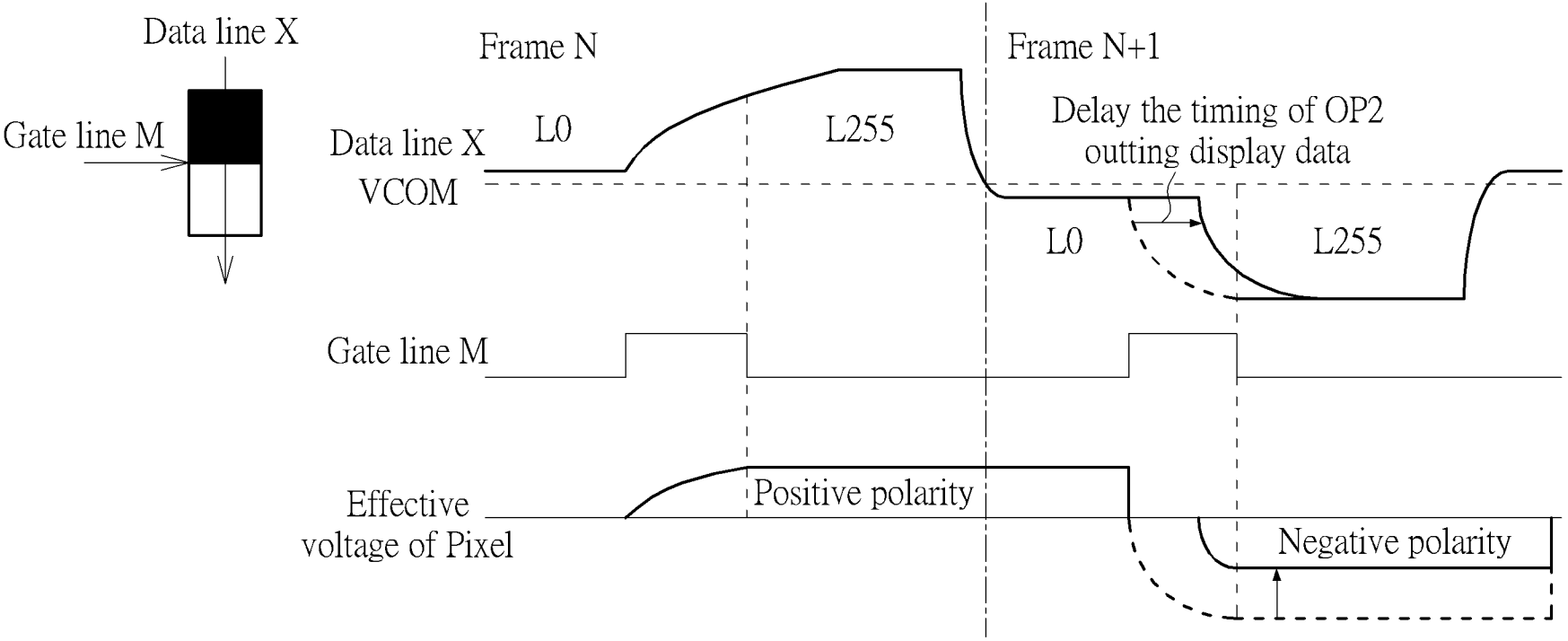
FIG. 7 is a waveform diagram of a specific pixel in the display panel driven by the output drivers.

For example, please refer to FIG. 7, which is a waveform diagram of a specific pixel in the display panel 206 driven by the output drivers OP1 and OP2. Similar to those shown in FIG. 5, the pixel receives display data with a data value L255 in positive polarity from the output driver OP1 in the frame N, and receives display data with the same data value L255 in negative polarity from the output driver OP2 in the frame N+1, where the voltage of the data line X changes from a level corresponding to the data value L0 to a level corresponding to the data value L255 in the boundary of the checkered pattern, resulting in the same data variation in positive and negative polarities. In this embodiment, the driving capability of the output driver OP1 is weaker than the driving capability of the output driver OP2, and may not be enough to drive the effective voltage of the pixel to reach a target level corresponding to the data value L255; hence, the magnitude of the effective voltage level in positive polarity is smaller than the magnitude of the effective voltage level in negative polarity. In such a situation, in the frame N+1, the timing of the output driver OP2 outputting display data is delayed, allowing the effective voltage to reach a level having the same magnitude as the effective voltage level allowed by the display data received in the frame N. The delayed display data results in a reduced effective voltage of the pixel in the frame N+1 since the data line X is not fully charged to the level corresponding to the data value L255 at the end of the gate control signal with the delay time. Note that the value of the delay time may be determined according to the driving capabilities of the output drivers OP1 and OP2. For example, if the difference between the driving capabilities of the output drivers OP1 and OP2 is larger, the delay time will be longer.

As shown in FIG. 7, the delay allows the display data to be forwarded to the data line X later, which changes the voltage of the data line X from the dashed line to the solid line; meanwhile, the effective voltage in negative polarity decreases from the dashed line to the solid line.

In another embodiment, if the driving capability of the output driver OP2 is weaker than the driving capability of the output driver OP1, the display data outputted by the output driver OP1 may be delayed. Please note that the timing controller 202 or the source driver 204 may include a delay circuit configured for the output driver OP1 and/or a delay circuit configured for the output driver OP2, where one or both of the delay circuits may generate a delay time on the output display data, to allow the effective voltage levels of the positive polarity and negative polarity in the pixel to have the same magnitude.

Figure 8:
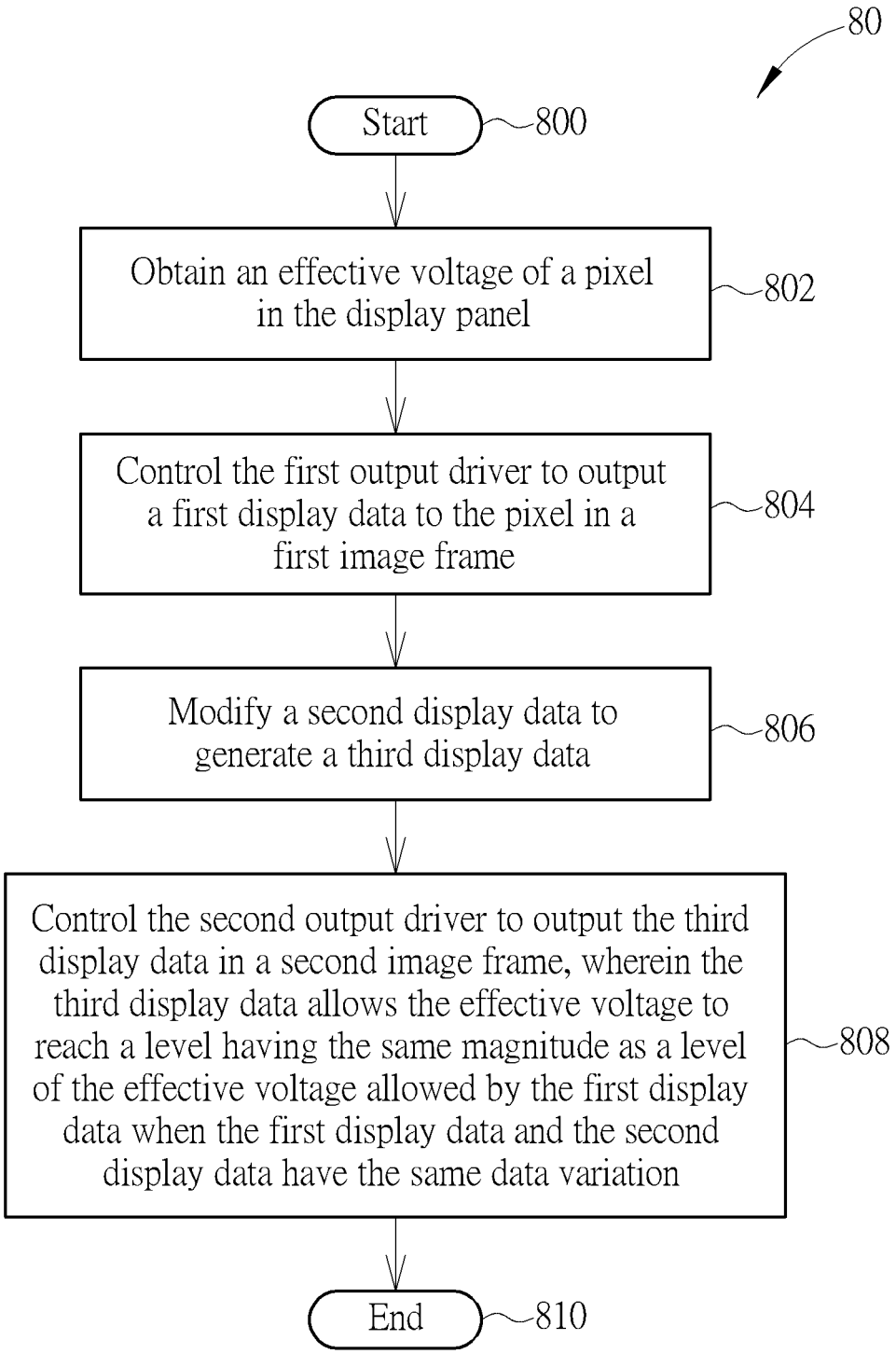
FIG. 8 is a flowchart of a process according to an embodiment of the present invention.

Please refer to FIG. 8, which is a flowchart of a process 80 according to an embodiment of the present invention. The process 80 may be utilized in a timing controller of a display control system such as the timing controller 202 shown in FIG. 2, to reduce or prevent image sticking appearing in a display panel controlled by the timing controller via the source driver, wherein the source driver includes a first output driver and a second output driver having different polarities. The process 80 includes the following steps:

Step 800: Start.

Step 802: Obtain an effective voltage of a pixel in the display panel.

Step 804: Control the first output driver to output a first display data to the pixel in a first image frame.

Step 806: Modify a second display data to generate a third display data.

Step 808: Control the second output driver to output the third display data in a second image frame, wherein the third display data allows the effective voltage to reach a level having the same magnitude as a level of the effective voltage allowed by the first display data when the first display data and the second display data have the same data variation.

Step 810: End.

According to the process 80 together with the display control system 20 shown in FIG. 2 and the output buffer circuit 402 shown in FIG. 4, the timing controller 202 may control the output driver OP1 to output a first display data to a pixel in an image frame and control the output driver OP2 to output a second display data to the pixel in another image frame. After obtaining the effective voltage of the pixel, the timing controller 202 knows that the effective voltage allowed by the first output data may be different from the effective voltage allowed by the second output data while the first output data and the second output data have the same data variation. Therefore, the timing controller 202 may modify the second display data to generate the third display data, and control the output driver OP2 to output the third display data instead of the second display data to the pixel, allowing the level of the effective voltage generated by the third display data to have the same magnitude as the effective voltage level allowed by the first display data. After the adjustment is complete, the display data of the output drivers OP1 and OP2 may generate similar effects on the effective voltage level.

Figure 9:
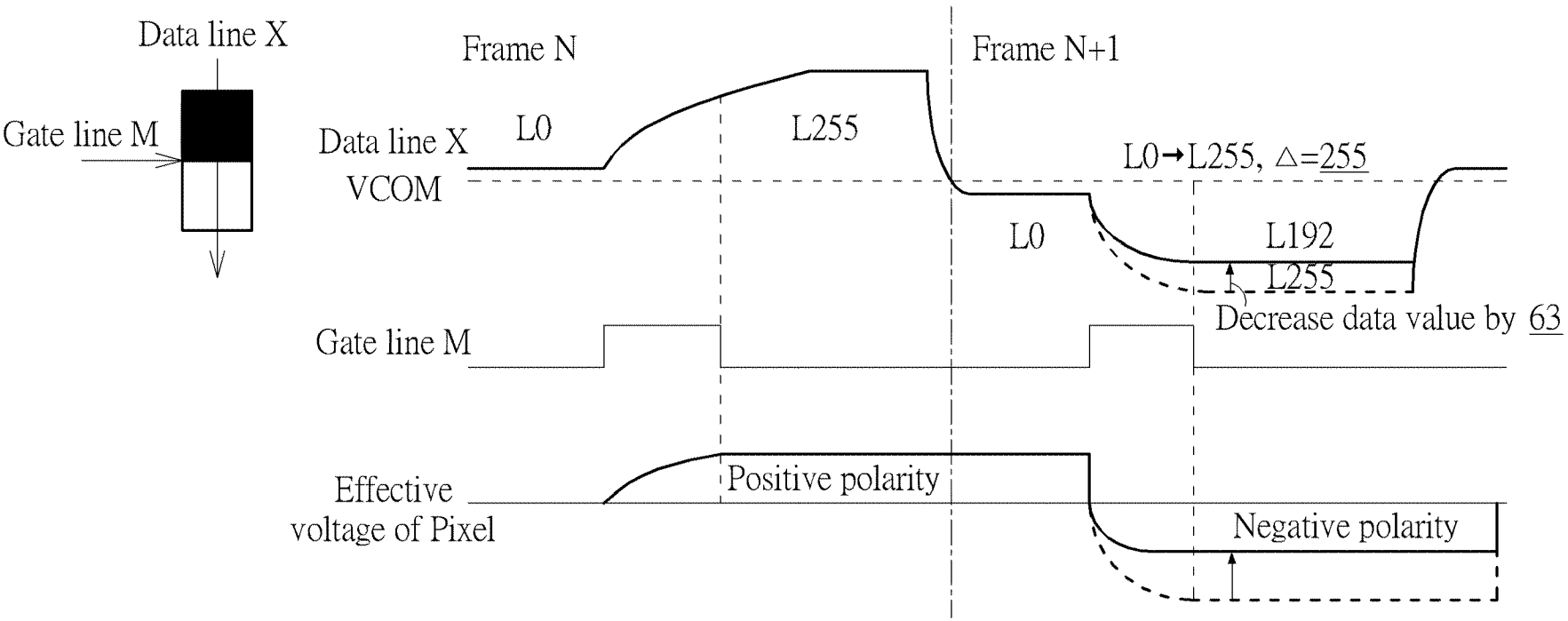
FIG. 9 is a waveform diagram of a specific pixel in the display panel driven by the output drivers.

For example, please refer to FIG. 9, which is a waveform diagram of a specific pixel in the display panel 206 driven by the output drivers OP1 and OP2. Similar to those shown in FIG. 5, the pixel receives display data with a data value L255 in positive polarity from the output driver OP1 in the frame N, and receives display data with the same data value L255 in negative polarity from the output driver OP2 in the frame N+1, where the voltage of the data line X changes from a level corresponding to the data value L0 to a level corresponding to the data value L255 in the boundary of the checkered pattern, resulting in the same data variation in positive and negative polarities. In this embodiment, the driving capability of the output driver OP1 is weaker than the driving capability of the output driver OP2, and may not be enough to drive the effective voltage of the pixel to reach a target level corresponding to the data value L255; hence, the effective voltage level in positive polarity is smaller than the effective voltage level in negative polarity. In such a situation, in the frame N+1, the timing controller 202 modifies the display data to have a data value L192 which is smaller than the original data value L255, since the driving capability of the output driver OP1 is weaker than the driving capability of the output driver OP2. The data variation from L0 to L192 in the frame N+1 may generate the effective voltage level having the same magnitude as the effective voltage level generated by the data variation from L0 to L255 in the frame N; hence, the image sticking problem may be prevented.

As shown in FIG. 9, the modification of data value changes the voltage of the data line X from the dashed line to the solid line; meanwhile, the effective voltage in negative polarity decreases from the dashed line to the solid line.

Please note that the data value L192 after modification may be determined according to the driving capability of the output driver OP1 and the driving capability of the output driver OP2. For example, if the difference between the driving capabilities of the output drivers OP1 and OP2 becomes larger, the data value may further be decreased to a smaller value.

Figure 10:
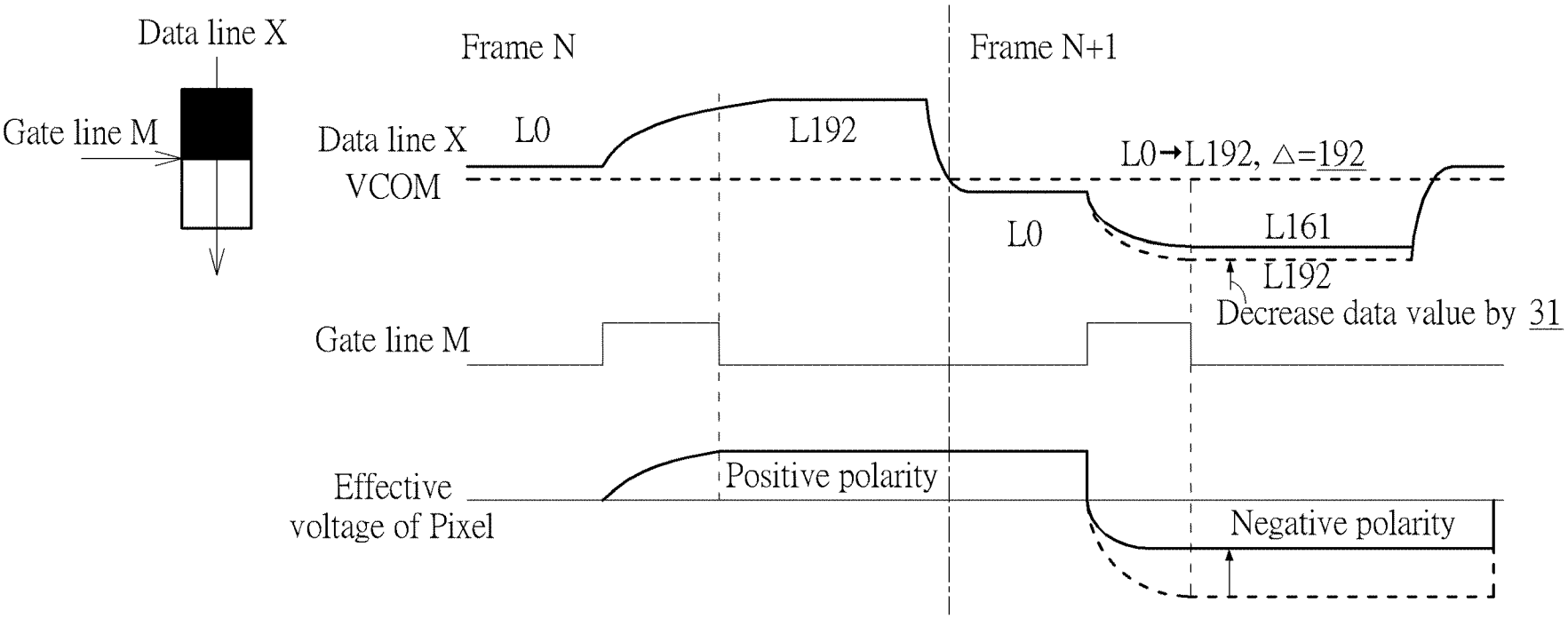
FIG. 10 is a waveform diagram of another pixel in the display panel driven by the output drivers.

Please refer to FIG. 10, which is a waveform diagram of another pixel in the display panel 206 driven by the output drivers OP1 and OP2, where the display data outputted to the data line X has a data value L192 changing from a data value L0. In this embodiment, the driving capability of the output driver OP1 still cannot charge the data line X to its target level, but this problem is much minor than the situation in FIG. 9. In such a situation, the timing controller 202 modifies the value of the display data in negative polarity from L192 to L161, and the decreasing degree is smaller than the embodiment shown in FIG. 9. Note that in the embodiment shown in FIG. 9, the data value decreases from L255 to L192, as decreased by 63; while in the embodiment shown in FIG. 10, the data value decreases from L192 to L161, as decreased by 31.

Please note that the present invention aims at providing a method for preventing or reducing image sticking appearing in a display panel. Those skilled in the art may make modifications and alternations accordingly. For example, in the above embodiments, the image sticking due to imbalanced effective voltage between positive and negative polarities may appear in any image pattern or image frame, while the checkered pattern is one of the image patterns easily influenced by image sticking. If the driving capability of the output driver with a polarity is stronger than the driving capability of the output driver with another polarity, the image sticking may appear in any image pattern when there is a significant variation on the voltage of the data line. Therefore, the methods of preventing image sticking provided in the embodiments of the present invention are applicable to any image pattern. In addition, in the embodiments of the present invention, the effective voltage of the pixel should be obtained by the source driver or the timing controller, for controlling the effective voltages of positive and negative polarities to be identical. The effective voltage may be obtained in various ways, e.g., detected by a detector included in the source driver or timing controller, or measured at a time point after the gate control signal ends. Further, the present invention prevents or reduces image sticking by allowing the effective voltages of the pixel in positive polarity and negative polarity to have the same magnitude, which may be achieved by adjusting the driving capability of the output driver (s), delaying the data outputted to the data line, modifying the data codes or data values, any other possible method to vary the effective voltage, and/or the combinations of the abovementioned methods. Moreover, in the embodiments of the present invention, in order to allow the effective voltage levels in positive and negative polarities to have the same magnitude, the effective voltage level in either positive polarity or negative polarity or both may be adjusted; this should not be limited to the implementations described in this disclosure.

To sum up, the present invention provides a method for preventing or reducing image sticking appearing in a display panel. In an embodiment, the driving capability of the output driver in the source driver is adjusted, which may be achieved by tuning the bias signal (s) provided for the output driver. In an embodiment, a display data outputted to the data line in the panel is delayed. In an embodiment, a data value is modified to change the effective voltage in the pixel. These methods allow the effective voltage in positive polarity to have the same magnitude as the effective voltage in negative polarity. As a result, the liquid crystal molecules in the pixel are driven by the display data with similar intensity in positive and negative polarities after long time operations, so that the image sticking problem may be prevented or reduced.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for a source driver, for preventing image sticking in a display panel coupled to the source driver, the source driver comprising a first output driver and a second output driver having different polarities, the first output driver configured with a first driving capability and the second output driver configured with a second driving capability, the method comprising:

obtaining an effective voltage of a pixel in the display panel, wherein the effective voltage of the pixel is a voltage driving liquid crystal molecules of the pixel to be twisted to a specific angle to generate an image; and adjusting the second driving capability of the second output driver to be identical to the first driving capability of the first output driver, to allow the adjusted second driving capability to drive the effective voltage to reach a level having the same magnitude as a level of the effective voltage driven by the first source driver with the same variation of display data.

2. The method of claim 1, wherein the first output driver receives a first bias signal from a first bias signal source, and the second output driver receives a second bias signal from a second bias signal source different from the first bias signal source.

3. The method of claim 2, wherein the second bias signal is adjusted when the first bias signal remains unchanged.

4. The method of claim 1, wherein the first output driver outputs a first display data to the pixel in a first image frame, and the second output driver outputs a second display data to the pixel in a second image frame next to the first image frame.

5. A method for a timing controller, for preventing image sticking in a display panel controlled by the timing controller via a source driver, the source driver comprising a first output driver and a second output driver having different polarities, the method comprising:

obtaining an effective voltage of a pixel in the display panel, wherein the effective voltage of the pixel is a voltage driving liquid crystal molecules of the pixel to be twisted to a specific angle to generate an image;

controlling the first output driver to output a first display data to the pixel in a first image frame; and controlling the second output driver to output a second display data to the pixel in a second image frame with a delay time without delaying the first display data;

wherein delay of the second display data adjusts the effective voltage of the pixel, allowing the effective voltage to reach a level having the same magnitude as a level of the effective voltage allowed by the first display data when the first display data and the second display data have the same data variation.

6. The method of claim 5, wherein the second display data is delayed when a driving capability of the first output driver is weaker than a driving capability of the second output driver.

7. The method of claim 6, wherein a value of the delay time is determined according to the driving capability of the first output driver and the driving capability of the second output driver.

8. A method for a timing controller, for preventing image sticking in a display panel controlled by the timing controller via a source driver, the source driver comprising a first output driver and a second output driver having different polarities, the method comprising:

obtaining an effective voltage of a pixel in the display panel, wherein the effective voltage of the pixel is a voltage driving liquid crystal molecules of the pixel to be twisted to a specific angle to generate an image;

controlling the first output driver to output a first display data to the pixel in a first image frame;

modifying a second display data to generate a third display data; and controlling the second output driver to output the third display data in a second image frame;

wherein the third display data allows the effective voltage to reach a level having the same magnitude as a level of the effective voltage allowed by the first display data when the first display data and the second display data have the same data variation.

9. The method of claim 8, wherein the second display data is modified to the third display data having a data value smaller than a data value of the second display data when a driving capability of the first output driver is weaker than a driving capability of the second output driver.

10. The method of claim 9, wherein the data value of the third display data is determined according to the driving capability of the first output driver and the driving capability of the second output driver.

* * * * *